US006299044B1

(12) United States Patent
Klindworth-Garron

(10) Patent No.: US 6,299,044 B1
(45) Date of Patent: Oct. 9, 2001

(54) ACCESSORY BAG

(76) Inventor: Heidi Marie Klindworth-Garron, 10 Nosband Ave.-#2M, White Plains, NY (US) 10605

( * ) Notice: Subject to any disclaimer, the term of this patent is extended or adjusted under 35 U.S.C. 154(b) by 0 days.

(21) Appl. No.: 09/561,419

(22) Filed: Apr. 28, 2000

(51) Int. Cl.[7] ..... A45F 3/02

(52) U.S. Cl. ..... 224/625; 224/616; 224/617; 224/637; 224/664

(58) Field of Search ..... 224/153, 614–618, 224/621, 625, 637, 627, 640, 663, 664, 665, 578, 579, 580

(56) References Cited

U.S. PATENT DOCUMENTS

| | | | | |
|---|---|---|---|---|
| 778,636 | * | 12/1904 | Coram . | |
| 2,565,006 | * | 8/1951 | Trickey . | |
| 2,710,639 | | 6/1955 | Farls . | |
| 4,350,274 | * | 9/1982 | Morgan . | |
| 4,515,300 | | 5/1985 | Cohen . | |
| 4,545,414 | | 10/1985 | Baum . | |
| 4,810,102 | * | 3/1989 | Norton . | |
| 4,887,751 | | 12/1989 | Lehman . | |
| 4,961,522 | * | 10/1990 | Weber | 224/153 X |
| 4,998,653 | | 3/1991 | LaBelle . | |
| 5,285,833 | | 2/1994 | Haxby . | |
| 5,292,042 | * | 3/1994 | Yamaguchi et al. . | |
| 5,405,068 | * | 4/1995 | Lovett | 224/153 |
| 5,407,111 | | 4/1995 | Lanouette et al. . | |
| 5,957,354 | * | 9/1999 | Mentken | 224/627 X |
| 6,123,239 | * | 9/2000 | Lovitt | 224/153 X |

* cited by examiner

*Primary Examiner*—Gregory M. Vidovich
(74) *Attorney, Agent, or Firm*—Mark Montague, Cowan, Liebowitz & Latman

(57) ABSTRACT

An accessory bag meant to be worn by a wearer, such as a handbag or pocketbook, is provided with forward, rear and two side surfaces of material, each of the side surfaces being attached to the forward and rear surfaces along respective seams and each of the side surfaces includes bilateral incisions. Two folded lengths of attaching material are attached at their open ends to the accessory bag along respective seams of the side surfaces, and portions of the folded lengths of attaching material pass through the incisions to reveal the closed ends thereof external to the enclosure defined by the various surfaces of the accessory bag. A first pair of attachment devices are coupled to respective closed ends of the folded lengths of attaching material, each attachment device being suitable to receive a respective end of a waist-strap. A second pair of attachment devices are coupled to respective side surfaces, each attachment device of the second pair being suitable to receive a respective end of a shoulder-strap. The accessory bag may include covers partially coupled to respective side surfaces that cover the attachment devices and the revealed closed ends of the attaching material.

14 Claims, 3 Drawing Sheets

ACCESSORY BAG

BACKGROUND OF THE INVENTION

The present invention relates to an accessory bag and, more particularly, to an accessory bag, such as a ladies' handbag or purse, that can be utilized with a detachable shoulder strap and/or with an adjustable/detachable waist-belt.

Typical accessory bags are held by the wearer using a shoulder strap. Other types of accessory bags, known commonly as "fannie-packs," are held around the wearer's waist by a waist-belt. While both types of bags are convenient and provide various advantages to the wearer, various shortcomings are experienced by each. For example, fannie-packs, waist pouches, and the like, are utilized in informal settings and allow the wearer to carry various items, such as lipstick and cosmetic cases, purses, a cellular telephone, etc., while at the same time allowing the wearer to freely use one's hands and shoulders for other purposes. Unfortunately, these types of handbags often are inappropriate for more formal settings. On the other hand, while handbags or purses having a shoulder strap may be appropriate for formal settings, they require use of the wearer's shoulder to carry the handbag which may be disadvantageous in other settings. For example, these handbags are less secure than waist pouches since the shoulder strap and attached handbag are plainly visible and may be vulnerable to "purse snatchers," whereas waist pouches generally are hidden and are more secure near the wearer's waist. One common way to overcome this problem is to "secure" the shoulder strap bag diagonally across one's body (e.g., right shoulder to left hip), but this approach seriously detracts from the wearer's appearance. Another disadvantageous feature of bags having shoulder straps is the inability to properly wear the bag while performing various activities, including jogging, dancing, bicycle riding, etc. In such cases, the bag typically moves sporadically which may cause damage to the contents of the bag, injury to other persons as well as to the wearer, and presents a negative appearance altogether.

Given the advantages and disadvantages of bags with shoulder straps and waist-belts discussed above, there are times when there is a need for a bag that embodies the advantages of both types of bags. For example, a career woman typically carries a somewhat "formal" type of handbag using a shoulder strap in the business setting, but in a less formal setting, there may be a need to maintain that handbag around one's waist. This would include visits to nightclubs where it is desirable not to leave the handbag unattended and to not have the handbag move sporadically during, for example, dancing. Also, protection of the handbag while traveling in populated cities is desired without having to place the shoulder strap across one's chest.

It therefore is an object of the present invention to provide a handbag that can be utilized with both a shoulder strap and a waist belt.

It is a further object of the present invention to provide a handbag having the above indicated feature of being able to be used with different types of straps in an aesthetically pleasing manner.

Various other objects, advantages and features of the present invention will become readily apparent to those of ordinary skill in the art, and the novel features will be particularly pointed out in the appended claims.

SUMMARY OF THE INVENTION

In accordance with the present invention, an accessory bag meant to be worn by a wearer is provided with forward, rear and two side surfaces of material, each of the side surfaces being attached to the forward and rear surfaces along respective seams and each of the side surfaces includes bilateral incisions. Two folded lengths of attaching material are attached at their open ends to the accessory bag along respective seams of the side surfaces, and portions of the folded lengths of attaching material pass through the incisions to reveal the closed ends thereof external to the enclosure defined by the various surfaces of the accessory bag. A first pair of attachment devices are coupled to respective closed ends of the folded lengths of attaching material, each attachment device being suitable to receive a respective end of a waist-strap. A second pair of attachment devices are coupled to respective side surfaces, each attachment device of the second pair being suitable to receive a respective end of a shoulder-strap.

As an aspect of the present invention, the accessory bag includes a seam that couples one of the side surfaces to either the forward or rear surface and the seam also couples the open end of one folded length of attaching material to the accessory bag. Further, another seam that couples the other side surface to the forward or rear surface also couples the open end of the other folded length of attaching material to the accessory bag.

As another aspect of the present invention, the open ends of each folded length of attaching material includes first and second open ends, and these first and second open ends of each folded length of attaching material are sewn to the accessory bag at different portions of the respective seam.

As a further aspect of the present invention, the first open end of each folded length of attaching material is attached near the top of the accessory bag and the other open end is attached near the bottom of the accessory bag.

As an additional aspect of the present invention, the bag further includes two covers that are partially coupled to respective side surfaces and that cover the attachment devices and the revealed closed ends of the attaching material.

As a feature of this aspect, each cover is sewn to the respective side surface along respective seams that are adjacent to the seams that attach the open ends of the folded lengths of attaching material to the accessory bag.

As a further feature, the respective seams of the folded lengths of attaching material are used also to sew each of the covers to the respective side surfaces to thus provide an additional attachment for the attaching material.

BRIEF DESCRIPTION OF THE DRAWINGS

The following detailed description, given by way of example and not intended to limit the present invention solely thereto, will best be appreciated in conjunction with the accompanying drawings, wherein like reference numerals denote like elements and parts, in which.

DETAILED DESCRIPTION OF CERTAIN PREFERRED EMBODIMENTS

Figure 1A:
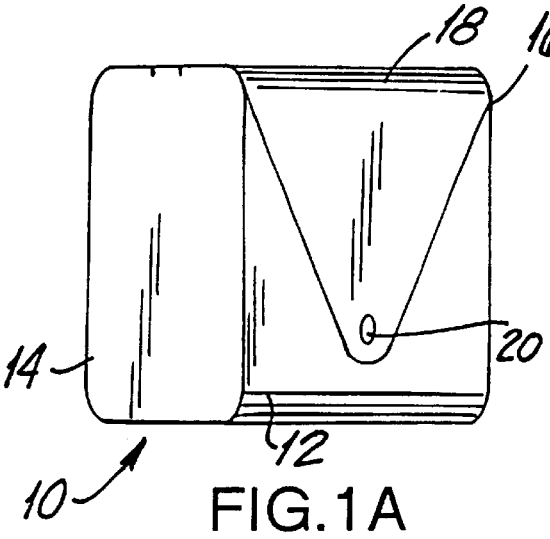
FIGS. 1A to 1E schematically illustrate different points of construction of the accessory bag of the present invention.

The accessory bag, also called handbag herein, of the present invention includes various strap holders, coverings, a strap and the handbag component, as further discussed below, that realizes the above-mentioned objectives. The accessory bag of the present invention initially is described with regard to the construction thereof. Referring now to FIGS. 1A–1E of the drawings, FIG. 1A illustrates the accessory bag 10 of the present invention in basic form which includes a front face 12, side faces 14, 16, a cover 18 and a clasp 20 adapted to secure cover 18 to front face 12. Although not shown in the drawings, the accessory bag may include a bottom face or, alternatively, the bottom may be defined by the attachment of the front and rear faces at the bottoms thereof. Of course, the accessory bag of the present invention may have a different basic construction such as known in the art. For example, rather than including a cover, clasp 20 may be located near the top of the bag so that the top of front face 12 may be detachably connected to the top of the bag's rear face (not shown). Further, the type of clasp 20 is not considered pertinent to the present invention and may be disregarded altogether. Still further, bag 10 of the present invention may be made of any suitable material that is known in the art. The styles and shape of bag 10 may be different than that depicted.

Figure 1B:
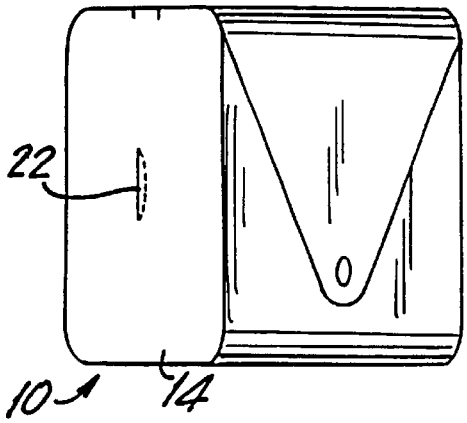
Figure 1C:
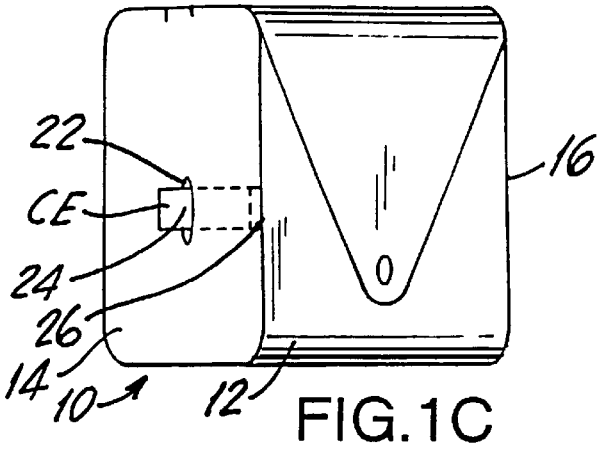
Figure 2:
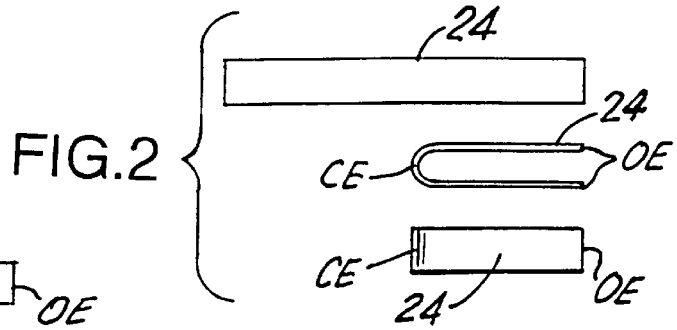
FIG. 2 schematically illustrates folded material utilized for attachments in accordance with the present invention.

Referring now to FIG. 1B, bag 10 of the present invention is manufactured by making a bilateral incision 22 (or other appropriate incision) into side faces 14, 16. Incision 22 may vary in dimension as would seem appropriate. As shown in FIG. 1C, a suitably strong piece of material 24 is placed to extend partially through incision 22. Material 24 is formed as shown in FIG. 2, wherein a piece of material is folded in half to form an open end OE, where the ends of the material overlap, and a closed end CE, which generally is the midway point along the length of the material. Referring back to FIG. 1C, the closed end CE of material 24 extends through incision 22 disposed external to bag 10 of the present invention, and the open end OE is disposed within the bag (so as to not be visible) and is sewn into a seam 26 that is utilized to connect side face 14 to front face 12. Alternatively, the open end OE may be sewn into a seam connecting side face 14 to the rear face of bag 10.

Figure 1D:
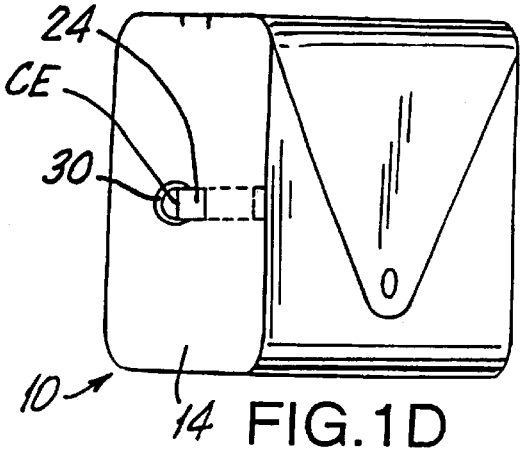
Figure 1E:
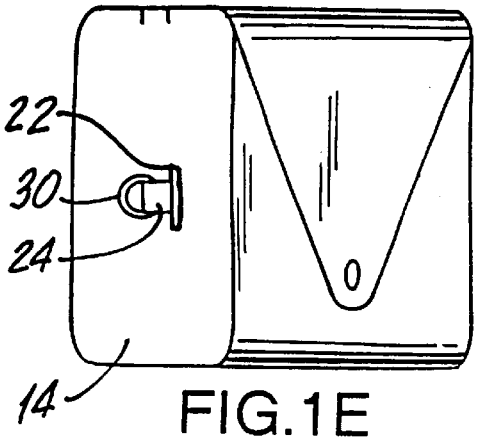

After the closed end CE of material 24 is inserted through incision 22, a ring 30 (e.g., a metal circular ring, a D-ring, etc.), loop or other suitable strap holder is connected to the closed end CE, as shown in FIG. 1D. Alternatively, material 24 is placed through ring 30 prior to being sewn in the bag's seam should it be desired to use a ring or other strap holder that is not easily connected to a closed ended piece of material. After the ring 30 is attached, incision 22 is sewn closed thus only revealing the closed end CE of material 24 extending from side face 14 of the bag with ring 30 displaced through the material, as shown in FIG. 1E.

The above steps and construction are applied to the other side surface 16 of bag 10 of the present invention. Thus, bag 10 includes two rings that, as will be discussed below, are adapted to be used as holders for a waist strap.

Figure 3A:
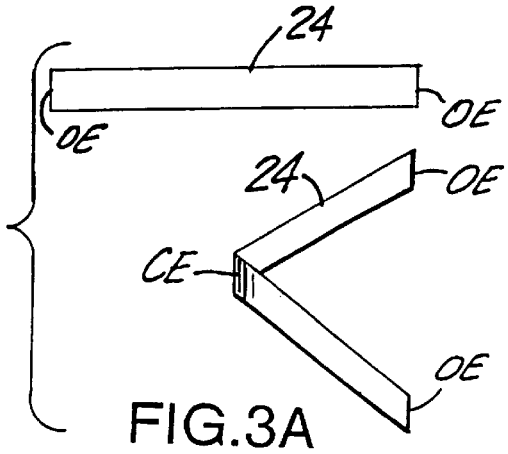
FIGS. 3A and 3B schematically illustrate construction of the waist-strap attachment in accordance with another embodiment of the present invention.
Figure 3B:
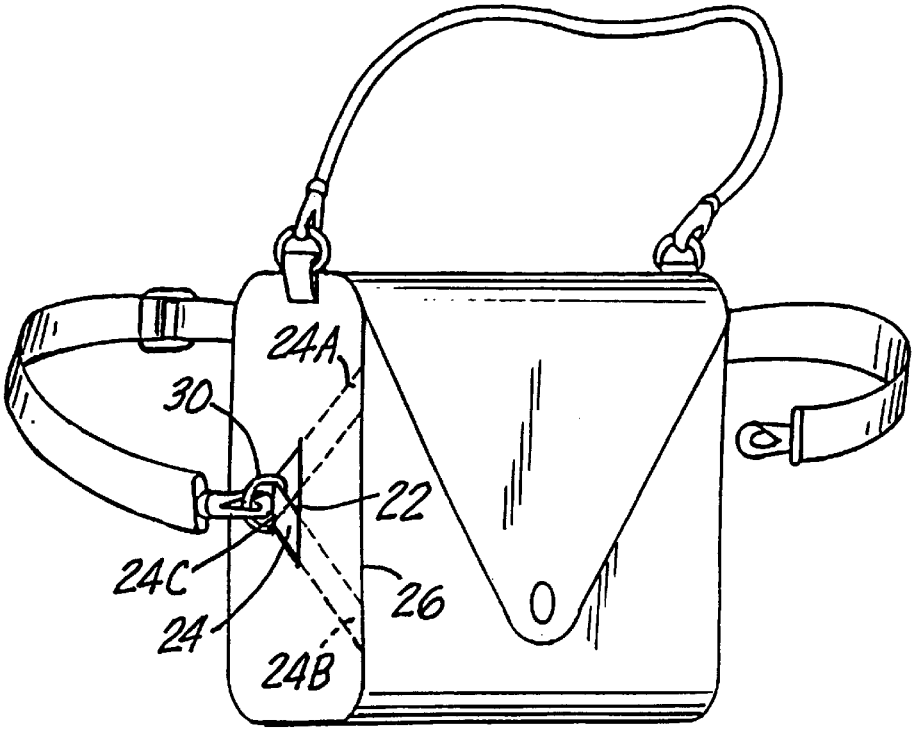

Material 24 discussed above is described as being folded in half prior to being sewn to the accessory bag of the present invention. In an alternative embodiment, and as shown in FIGS. 3A and 3B, material 24 may be folded in half in the manner shown in FIG. 3A wherein the two open ends OE remain apart from one another. In this case, one open end 24A of the material is sewn into seam 26 at a position separate from that position at which open end 24B of the material is sewn. In general, open end 24A may be sewn into the seam near the top of the accessory bag whereas open end 24B may be sewn into the seam near the bottom of the accessory bag. This structure tends to be substantially stronger than the embodiment described above (as shown in FIG. 1C) with the further advantage that material is spread out along the seam thus preventing any bulging that otherwise would occur. Moreover, FIG. 3B shows that this construction allows for the closed end 24C of the material to appear somewhat different and more fanciful than the design previously described, with ring 30 or other strap connector being coupled thereto in like manner.

Figure 4:
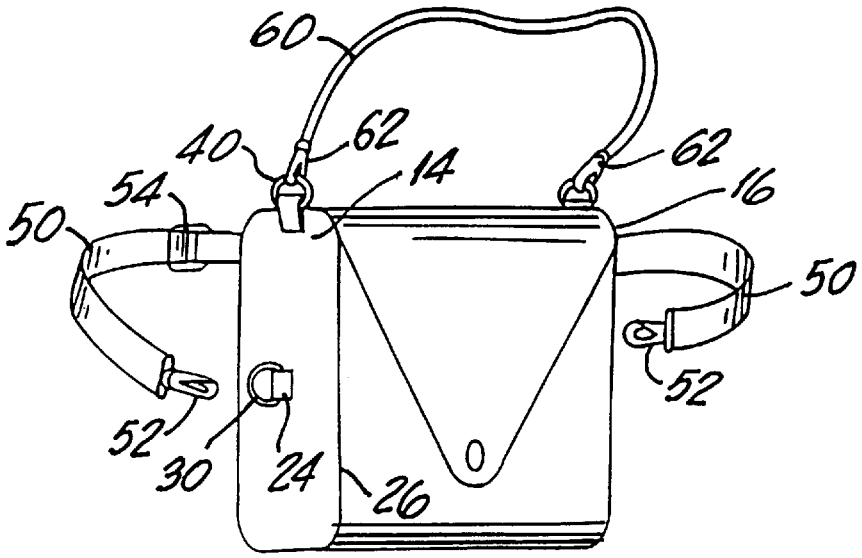
FIG. 4 schematically illustrates the accessory bag of the present invention shown with detachable waist and shoulder straps.

Turning now to FIG. 4, accessory bag 10 of the present invention includes a pair of attachment straps 40 coupled to the bag in any manner well known in the art. For example, attachment straps 40 can be in the form of D-rings or circular rings coupled to side surfaces 14, 16 (or even to a top surface) via appropriate material or device. The specific construction of the attachment straps is not considered pertinent to the present invention.

The accessory bag of the present invention is adapted to be worn with a waist-strap 50, such as shown in FIG. 4, which includes appropriate connectors 52 and a size adjustment mechanism 54 for allowing the waist strap length to be adjusted. The accessory bag of the present invention further may be worn with a shoulder strap, such as strap 60 having two connectors 62 as shown in FIG. 4. Shoulder and waist straps are well known in the art and thus further description thereof is omitted herein.

In accordance with a further feature of the present invention, ring 30 and the visible portion of material 24 (on each side of the bag), which operate as the bag's waist-strap connector, may be covered in various novel manners to provide an aesthetically pleasing appearance as well as to provide additional strength to the connector, as discussed below.

Figure 5A:
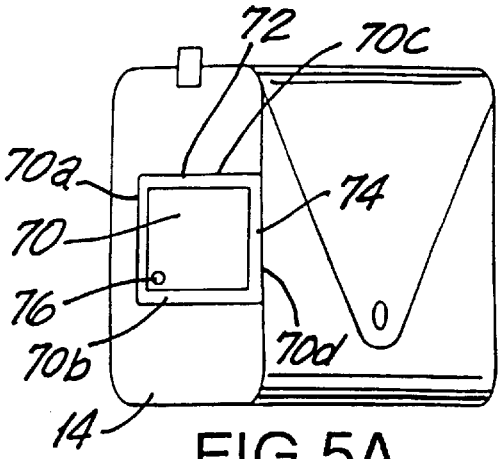
FIGS. 5A to 5C schematically illustrate various alternative embodiments of the feature of covering the waist-strap connectors in accordance with the present invention.

Referring to FIG. 5A, the accessory bag 10 of the present invention includes a cover 70 partially sewn to side face 14. Cover 70 is shown square but may be rectangular to accommodate bags of varying dimensions. Cover 70 may have other shapes including round, oval, star-like, etc., A similar cover is partially sewn in side face 16 (not shown) in like manner. In accordance with the structure shown in FIG. 5A, cover 70 is positioned to fully cover ring 30 and the closed end of material 24 (thus not shown in FIG. 5A) and is coupled to bag 10 by means of seams 72, 74 along respective ends 70*c*, 70*d* of cover 70 sewn into side face 14. Ends 70*a*, 70*b* of cover 70 are not sewn to the bag so that ring 30 may be accessed by simply lifting the loose comer of cover 70 in order to connect or disconnect a waist-strap to/from ring 30. Optionally, connectable snaps 76 may be attached to the cover's loose end and the opposing surface on the bag to prevent the cover from flapping. With or without a snap, however, cover 70 provides an aesthetically pleasing appearance, especially when the accessory bag of the present invention is utilized with a shoulder-strap in a formal setting.

In accordance with a further additional feature of the present invention, seam 74 is sewn through the open ends of material 24 in either configuration shown in FIG. 1C or FIG. 3B, thus providing additional strength to the coupling mechanism that ultimately attaches to a waist-strap. Seam 74 may be adjacent to or on top of seam 26. This is especially important in light of the amount of strength that is required to maintain a tight fit around one's waist when using a waiststrap. Alternatively, seam 26 is used to attach cover end 70*d* to the accessory bag, rather than provide two separate seams.

Figure 5B:
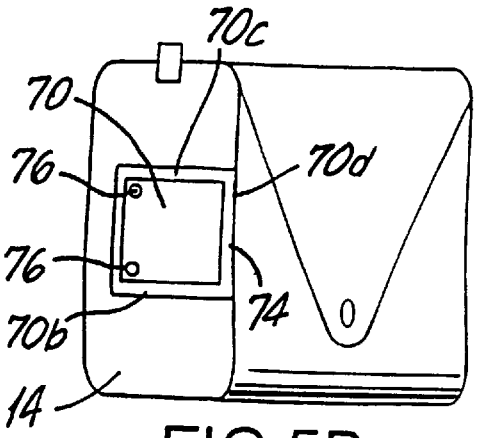

FIG. 5B shows an alternative design for attaching cover 70 to the accessory bag. While similar to the design shown in FIG. 5A, cover 70 is sewn to side 14 only along a single seam 74, leaving three ends 70*a*, 70*a*, 70*c* loose, and two snaps 76, 76 are provided to allow the wearer to gain access to ring 30 (not shown in FIG. 5B) to connect and detach a waist-strap. Like the design discussed with reference to FIG. 5A, seam 74 may be adjacent to, on top of, or the same as seam 26.

Figure 5C:
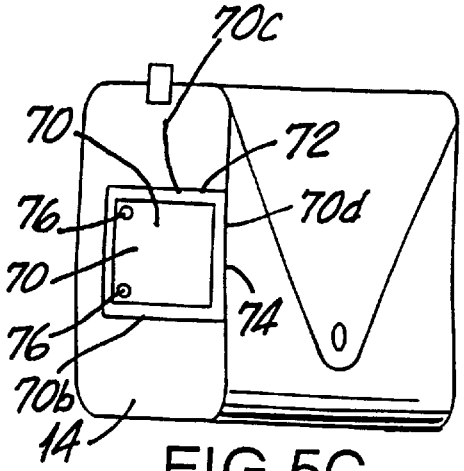

FIG. 5C shows yet another alternative design for attaching cover 70 to the accessory bag. In this design, cover 70 is sewn to side 14 along three of its sides 70*a*, 70*c*, 70*d*, leaving only the single side 70*a* open. Then, depending on the type of material used for cover 70 as well as the various sides of the accessory bag 10 of the present invention, two snaps 76 optionally may be installed to ensure that cover 70 appears "natural" on bag 10.

As can be appreciated from the above description of the various embodiments of the accessory bag of the present invention, a formal type of handbag embodying the various features discussed herein may be utilized in a somewhat formal setting that requires the use of a shoulder strap. In such case, the above-described cover and the particularly described designs suitably hide from view generally unfashionable waist-strap connectors. The cover's seam as well as the disclosed snaps provide for an aesthetically pleasing appearance. The cover additionally and advantageously provides added strength to the particular mechanism that is utilized with a waiststrap. Namely, the coupling mechanism. Still further, the coupling mechanism, even without the cover, is designed to be substantially strong for suitable use with a waist-strap. All of these features, individually and collectively, provide an accessory bag that overcomes various shortcomings encountered by currently existing designs.

Finally, while the present invention has been particularly shown and described in conjunction with preferred embodiments thereof, it will be readily appreciated by those of ordinary skill in the art that various changes may be made without departing from the spirit and scope of the invention. For example, the present invention should not be limited to the specific styles, sizes and shapes discussed herein and shown in the drawings and should be applied to generally any style, size and bag shape. As another example, the discussion is directed to attaching a waist-strap, as well as a shoulder strap, to coupling mechanisms attached to the side panels of a bag. However, the present invention is not limited solely to such construction and is equally applicable to providing coupling mechanisms of any part of the accessory bag, including the front panel, rear panel, top panel and bottom panel.

Therefore, it is intended that the appended claims be interpreted as including the embodiments described herein, the alternatives mentioned above, and all equivalents thereto.

What is claimed is:

1. An accessory bag adapted to be worn by a wearer, comprising:

forward and rear surfaces of material;

two side surfaces of material; each of said side surfaces of material being attached to said forward and rear surfaces along respective seams, each of said side surfaces including bilateral incisions;

two folded lengths of attaching material having open and closed ends; said open ends of each of said folded lengths of attaching material being attached to said accessory bag along respective seams of said side surfaces, portions of said folded lengths of attaching material passing through the incisions of the respective side surfaces to reveal the closed ends external to an enclosure defined by said forward, rear and side surfaces of the accessory bag;

a first pair of attachment devices coupled to respective closed ends of said folded lengths of attaching material, each of said attachment devices of said first pair being adapted to receive a respective end of a waist-strap; and a second pair of attachment devices coupled to respective side surfaces, each of said attachment devices of said second pair being adapted to receive a respective end of a shoulder-strap.

2. The accessory bag of claim 1, wherein the accessory bag includes a single seam for coupling one of said side surfaces to one of said forward and rear surfaces and for coupling said open end of one of said folded lengths of attaching material to said accessory bag, and includes a single seam for coupling the other of said side surfaces to one of said forward and rear surfaces and for coupling said open end of the other folded length of attaching material to said accessory bag.

3. The accessory bag of claim 1, wherein said open ends of each of said folded lengths of attaching material includes first and second free ends, said first and second free ends of each of said folded lengths of attaching material being attached to said accessory bag at different portions of the respective seam.

4. The accessory bag of claim 3, wherein said first open end of each of said folded lengths of attaching material is attached along a portion of the respective seam near a top of the accessory bag, and said second open end of each of said folded lengths of attaching material is attached along a portion of the respective seam near a bottom of the accessory bag.

5. The accessory bag of claim 1, wherein each of said attachment devices of said first pair and second pair is a ring.

6. The accessory bag of claim 1, further comprising two covers partially coupled to respective side surfaces for covering the attachment devices and the revealed closed ends of the attaching material.

7. The accessory bag of claim 6, wherein each of said two covers are sewn to the respective side surfaces along at least respective first seams that are adjacent to the respective seams that attach the open ends of the folded lengths of attaching material to the accessory bag.

8. The accessory bag of claim 7, wherein said respective first seams used to sew each of said two covers to the respective side surfaces also sew the open ends of the folded lengths of attaching material to the accessory bag to provide an additional attachment for said folded lengths of attaching material.

9. The accessory bag of claim 6, wherein each of said two covers are sewn to the respective side surfaces by the respective seams that attach the open ends of the folded lengths of attaching material to the accessory bag.

10. The accessory bag of claim 6, wherein each of said two covers is substantially rectangular in shape and has four ends, and at least two adjacent ends of each of said covers are sewn to the respective side surfaces of the accessory bag.

11. The accessory bag of claim 10, wherein each of said covers and each of said side surfaces of the accessory bag have detachable connection snaps for retaining each of said covers to a respective side surface, said covers having said snaps along an end not sewn to the respective side surface.

12. An accessory bag adapted to be worn by a wearer, comprising:

forward and rear surfaces of material;

two side surfaces of material, each of said side surfaces of material being attached to said forward and rear surfaces along respective pairs of seams;

a first pair of attachment devices adapted to receive respective ends of a waist-strap;

attachment means for coupling each of said attachment devices of said first pair to the respective side surfaces of said accessory bag;

a second pair of attachment devices coupled to the respective side surfaces, each of said attachment devices of said second pair being adapted to receive a respective end of a shoulder-strap; and a pair of covers coupled to the respective side surfaces and adapted to fully cover the first pair of attachment devices and any visible portion of said attachment means, wherein said attachment means includes first and second attachment means respectively sewn along one of said seams defined between an associated said side surface and one of said forward or rear surfaces of the bag and each of said covers are sewn to said respective side surfaces adjacent to said seams that attach said first and second attachment means to said accessory bag.

13. The accessory bag of claim 12, wherein said respective seams used to sew each of said two covers to the respective side surfaces also operate to couple the first and second attachment means to the accessory bag to provide an additional attachment for said attaching means.

14. An accessory bag adapted to be worn by a wearer, comprising:

forward and rear surfaces of material;

two side surfaces of material, each of said side surfaces of material being attached to said forward and rear surfaces along respective pairs of seams;

a first pair of attachment devices adapted to receive respective ends of a waist strap;

attachment means for coupling each of said attachment devices of said first pair to respective said side surfaces of said accessory bag;

a second pair of attachment devices respectfully coupled to said side surfaces, each of said attachment devices of said second pair being adapted to receive a respective end of a shoulder strap, and a pair of covers respectively coupled to said side surfaces and adapted to fully cover said first pair of attachment devices and any visible portion of said attachment means, wherein said attachment means includes first and second attachment means respectively sewn along one of said seams defined between an associated said side surface and one of said forward or rear surfaces of the bag and each of said. covers are coupled to the respective side surfaces by the same respective seams that attach the first and second attachment means to the accessory bag.

* * * * *